United States Patent [19]

Tateishi

[11] 4,437,394

[45] Mar. 20, 1984

[54] DIRECTIONAL AIR FLOW FAN

[76] Inventor: Arthur K. Tateishi, 25 Warrender, Apt. 202, Toronto, Ontario, Canada

[21] Appl. No.: 289,778

[22] Filed: Aug. 3, 1981

[51] Int. Cl.[3] ..... F24F 13/16

[52] U.S. Cl. ..... 98/40 V; 74/25; 415/125

[58] Field of Search ..... 74/25; 98/40 V, 94 R, 98/94 AC, 121 A; 415/125

[56] References Cited

U.S. PATENT DOCUMENTS

| | | | |
|---|---|---|---|
| 697,448 | 4/1902 | Coleman | 98/40 V |
| 1,861,608 | 6/1932 | Persons | 415/125 |
| 2,768,782 | 10/1956 | Tateishi | 417/361 |
| 2,836,350 | 5/1958 | Tateishi | 415/125 |
| 4,084,491 | 4/1978 | Spotts et al. | 98/121 A |
| 4,131,776 | 12/1978 | Ehrenberger | 74/25 X |

FOREIGN PATENT DOCUMENTS

| | | | |
|---|---|---|---|
| 56-68745 | 6/1981 | Japan | 98/121 A |

*Primary Examiner*—Edward G. Favors
*Assistant Examiner*—Harold Joyce

[57] ABSTRACT

The present invention provides a fan structure having a housing and vane arrangement adapted to oscillate relative to the housing. The fan motor is used to operate both the fan blade and the vane arrangement. The structure includes a drive system having a rotating drive shaft for driving an oscillator which is adapted to oscillate the vanes and a control mechanism for controlling on/off switching of the drive system to the oscillator. Accordingly, the fan blade is operated independently of the oscillator so that the structure can be run both with and without oscillation of the vanes.

18 Claims, 10 Drawing Figures

FIG. 8.
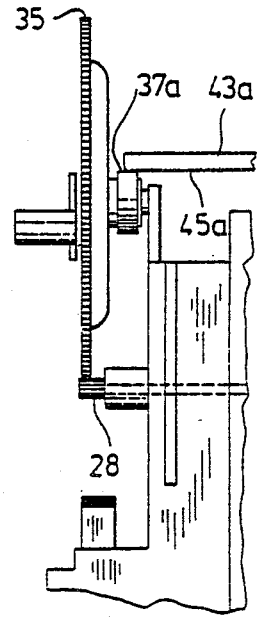
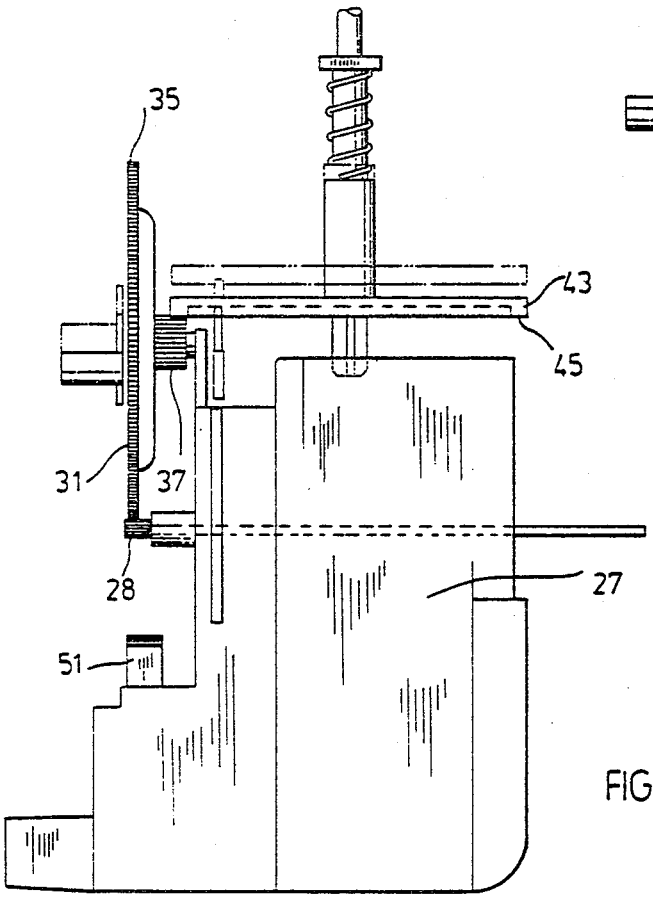
FIG. 7.

DIRECTIONAL AIR FLOW FAN

FIELD OF THE INVENTION

The present invention relates to a fan structure having a housing and a vane arrangement adapted to oscillate relative to the housing and operated from the fan motor in a manner such that the oscillation of the vane arrangement can be turned on and off independently of the fan blade.

BACKGROUND OF THE INVENTION

There are presently available a number of different types of oscillating fan arrangements. According to the most popular type, the fan comprises a swivel type housing having a plurality of fan blades fixed within the housing. This particular type of oscillating fan requires a very substantial and powerful oscillation mechanism in order to rotate the entire housing of the fan. Furthermore, due to the amount of work required to move the entire housing, there is generally a heavy drain on the fan motor.

There are a number of less well known oscillating fan arrangements in which the fan housing remains stationary, while the vanes of the fan oscillate relative to the housing. However, according to most of these arrangements there is either a two motor system in which one motor is used to drive the fan blade and the second motor is used to drive the oscillating vanes, as described in U.S. Pat. No. 4,084,491 issued Apr. 18, 1978 to Spotts et al or there is a fixed connection between the vanes and the fan motor, so that the fan blade and the vanes cannot be controlled independently of one another as described in U.S. Pat. No. 1,861,608 issued June 7, 1932 to L. M. Persons.

A more unique oscillating fan is described in U.S. Pat. No. 2,768,782 issued Oct. 30, 1956 to A. K. Tateishi. According to this latter patent, an electric fan is provided in which the fan motor is used to operate both the fan blade and the vanes which are adapted to oscillate relative to the fan housing. A single rotational control member is used to operate both the motor and the oscillating vanes. The motor is turned on through an initial rotation of the control member and further rotation of the control member is required to cause the vanes to oscillate. With this single control there is an initial slippage of the drive system as it is gradually moved into an operative position in order to free the motor to reach maximum rpm's. However if the control member is not properly adjusted after the motor reaches maximum rpm, the slippage will continue resulting in inefficient operation of the oscillating vanes and possible wear on the components in the drive system. Furthermore the arrangement is relatively complicated, since a single control member is used to rotationally adjust both the on/off switching of the fan and the incremental adjustment of the drive system which is in itself quite complex. This drive system includes a crank and rocker arrangement requiring numerous components and connections to the vanes in order to produce vane oscillation making the system obsolete from a cost standpoint.

An additional drawback of the earlier Tateishi patent is that, the drive system may be adjusted to the extent that it is effectively locked in a non-slip position via the control member which is not desirable in the event that the vanes become jammed putting undue pressure on the drive system resulting in wear and damage to both the drive system and the fan motor.

SUMMARY OF THE PRESENT INVENTION

The present invention provides a fan structure having a housing, a fan blade rotatable within said housing, at least one vane adapted to oscillate relative to the housing, oscillation means for oscillating the vane, a motor for operating the fan blade and oscillation means, a motor control switch, a drive system for driving the oscillation means from the motor and a control mechanism which is independent of the motor control switch for controlling on/off switching of the oscillation means through the drive system.

The drive system comprises a rotatable drive shaft, a drive member rotated by the motor and a drive pick up member rotationally coupled to the drive shaft for rotation thereof. The control mechanism is provided with means for moving the drive pick up member into and out of oscillation producing driving contact with the drive member for the on/off switching of the oscillation means for turning on and for turning off oscillation of the oscillating vane.

Through the use of an independent control for the vane oscillation which either assumes an on or off position, there is no need for accurate adjustment in order to assure efficient vane oscillation. Furthermore the provision of a rotary drive shaft to the oscillating vanes enables the use of an extremely simple yet efficient set-up at the oscillation means.

According to an aspect of the present invention, the drive pick up member is biased into a drive producing contacting position with the drive member by spring means and is moveable away from the drive producing contact position through the control mechanism, which is adapted to overcome the pressure exerted by the spring means. According to this aspect of the invention, the spring pressure is adequate to ensure positive contact through the drive system when the vanes are free to oscillate. However in the event that the vanes become jammed, the resiliency of the spring enables the drive pick up member to move out of driving contact with the drive member to prevent binding of the fan motor.

BRIEF DISCUSSION OF THE DRAWINGS

The above, as well as other advantages and features of the present invention, will be described in greater detail according to the preferred embodiments of the present invention wherein:

FIG. 7 is a side view of one preferred form of a drive assembly;

FIG. 8 is a side view of a second preferred form of a drive assembly; and

DETAILED DESCRIPTION ACCORDING TO THE PREFERRED EMBODIMENTS OF THE PRESENT INVENTION

Figure 1:
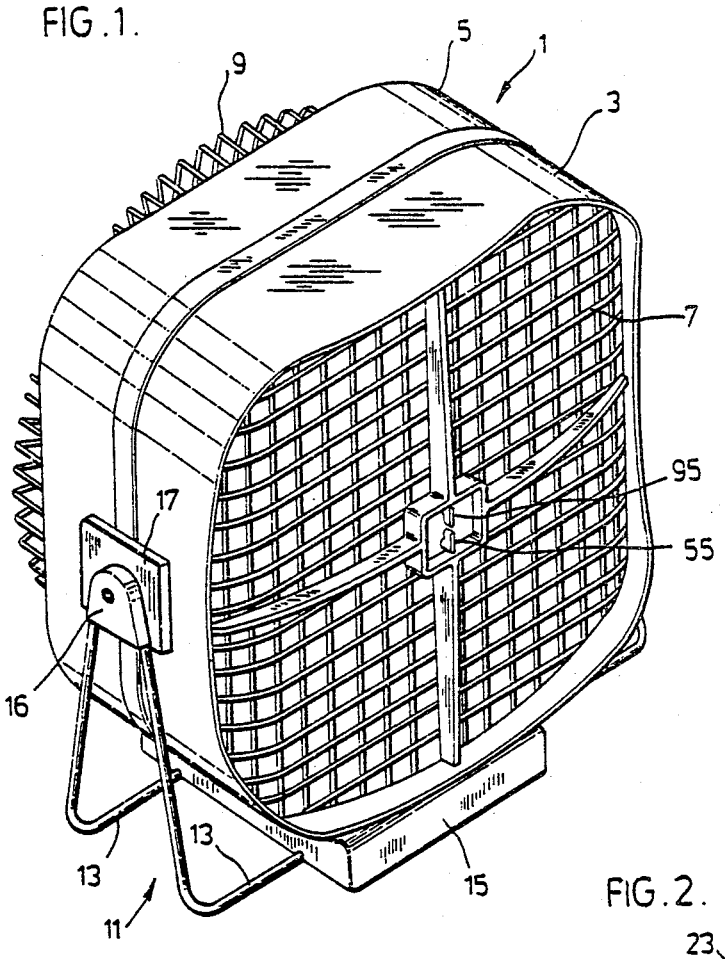
FIG. 1 is a front perspective view looking down on a fan structure according to a preferred embodiment of the present invention.
Figure 2:
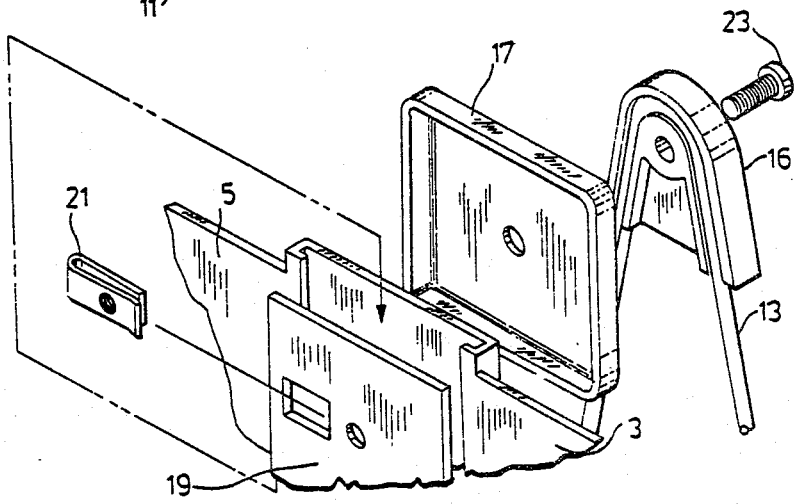
FIG. 2 is an exploded perspective view of the mounting arrangement used in FIG. 1 to mount the fan housing to its supporting stand.

Referring first to FIGS. 1 and 2, the fan structure comprises a housing generally indicated at 1 and formed of a forward housing portion 3 and a rearward housing portion 5 which mate with one another. These two housing portions are separate for gaining access to the interior of the fan structure.

Forward housing portion 3 is provided with a forward grill 7 while the rearward housing portion includes a rear grill 9. These two grills are adapted to inhibit the penetration of a finger or the like into the interior of the structure. The rear grill, which is adjacent the fan blade, is additionally increased in depth so that in the event that a child were able to get his or her finger in the grill it would still be difficult to reach to the fan blade.

The fan housing is mounted to a stand generally indicated at 11. The stand is formed from a base 15 with the legs 13 of the stand fitted to the base and the sides of the fan housing. The base of the stand enables the fan to be used in a standard mounted position, as shown in FIG. 1 where it sits upright on a floor or desk top, or in a wall or ceiling mounted position as desired.

The stand legs are fitted through a collar portion 16 which seats with a side plate 17 fitted to the side of the fan. Located interiorly of the fan is a locator plate 19 to which a tinnerman nut is secured. The collar portion 16 and the side plate 17, as well as the locator plate 19, are all provided with openings which align with one another when the structure is assembled. Bolt 23 is then fitted through the aligned openings and threaded into the tinnerman nut to hold the structure together. Bolt 23 may then be tightened to the extent that the fan housing can be supported in essentially any position relative to the stand. Furthermore, due to the friction between collar 16 and side plate 17 at both sides of the fan the fan housing is easily held in the position to which it is adjusted. The tinnerman nut acts as a lock washer so that bolts 23 at either side of the housing remain tight regardless of the number of adjustments made.

Although a number of different types of materials could be used, the fan housing as well as the collar portions and side plates are formed from a lightweight durable plastic which substantially reduces the weight of the housing and which provides good frictional resistance in supporting the housing at the different positions. The stand base 15 is also preferably made from the same plastic material which further reduces the weight of the fan, which is particularly useful when the fan is used in either a wall or a ceiling mount position.

Figure 3:
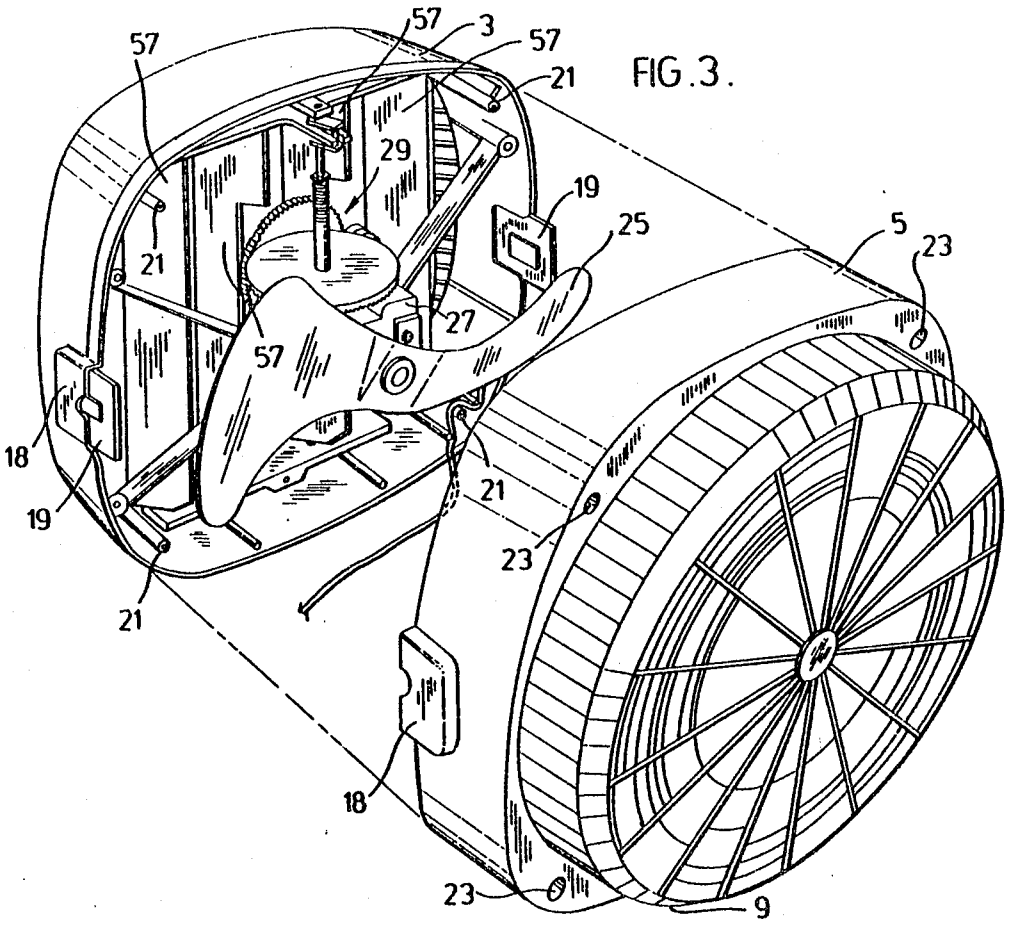
FIG. 3 is an exploded perspective view of the fan housing and its internal components as shown in FIG. 1.

FIG. 3 shows the fan housing broken open to expose the internal components of the fan structure. Here it can be seen where the rearward grill has substantial depth. In addition, FIG. 3 shows pocket portions 18 at the side of both the rear and forward housing portions which are adapted to receive the interior plate 19 and which locate side plates 17 in position.

FIG. 3 additionally shows four threaded posts 21 provided on the forward housing portion, one at each corner region. The rear housing portion is provided with openings 23 which align with the posts to receive bolts which are not shown in the drawings for removably securing the two housing portions to one another.

Housed within the fan is an electric motor 27, a fan blade 25 rearwardly of the electric motor, a plurality of vanes 57 forwardly of the motor, an oscillating structure for oscillating the vanes, a drive system generally shown at 29 for driving the oscillating structure from the motor 27 and a control mechanism for connecting and disconnecting the oscillating structure from the electric motor through the drive system.

Figure 6:
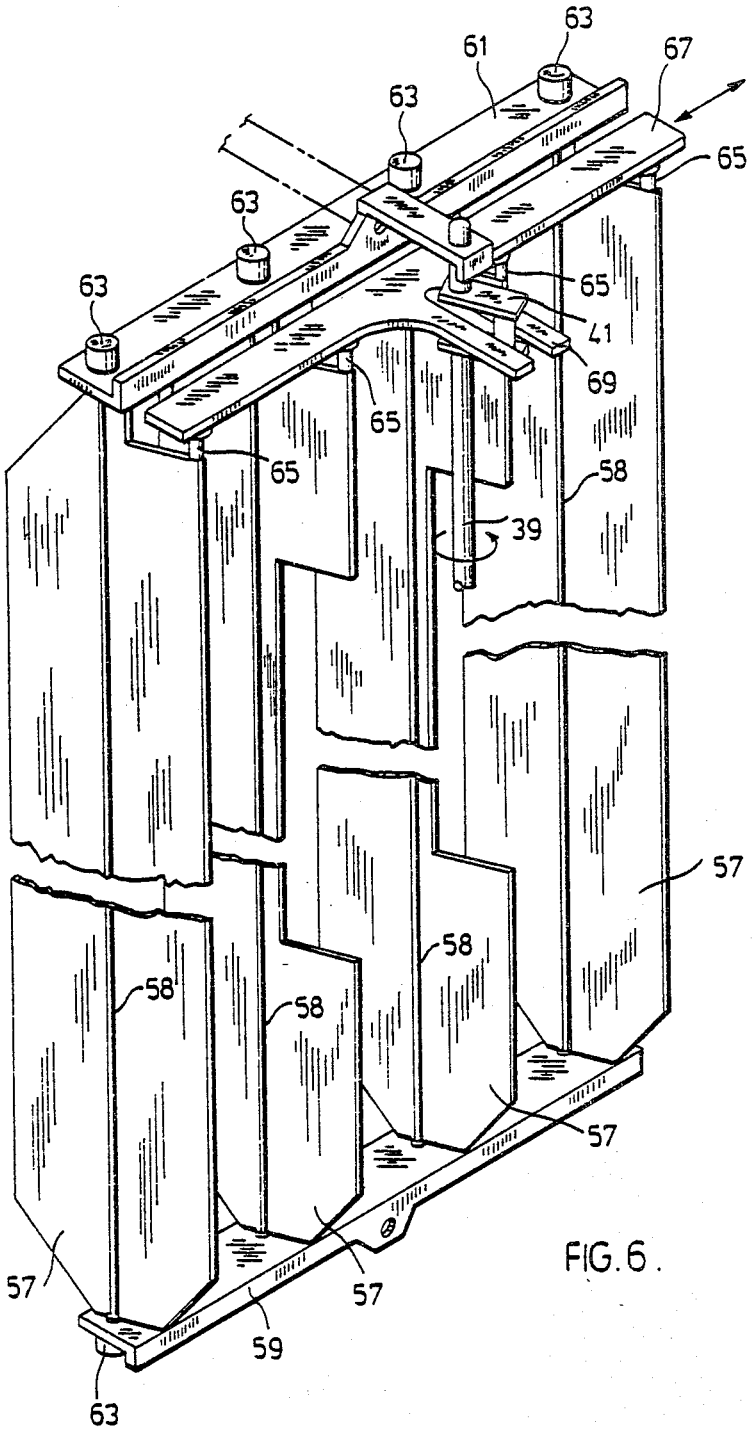
FIG. 6 is a forward perspective view looking down on the vane arrangement and oscillation system in the fan structure of FIG. 3.

The oscillating vanes, which are adapted to direct the flow of air from the fan blade, are well shown in FIG. 6. These vanes, which are again preferably made from light weight plastics, are pivotally secured between a lower support 59 and an upper support 41. The pivotal connection between the supports and the vanes are shown at 63. The vanes are oscillated through a Scotch-yoke mechanism which comprises a sliding bracket 67 pivotally connected to the vanes at 65 and presenting an open ended grooved bracket portion 69. A drive shaft 39 from the drive system is provided at its upper end with a crank portion 41, which fits into the grooved bracket portion 69. With this very simple arrangement, rotation of the drive shaft is effectively and efficiently translated to reciprocal motion to oscillate vanes 57 at the front of the fan when the drive system is in an oscillation producing position.

Vanes 57 are pivoted to the upper and lower brackets at the midpoint 58 of each vane. This central pivoting of the vanes gives equal air pressure on either side of the louvre blades of the vanes to maximize the ease of oscillation. Accordingly, there is very little strain applied on the motor from the oscillation of the vanes.

Figures 4, 5:
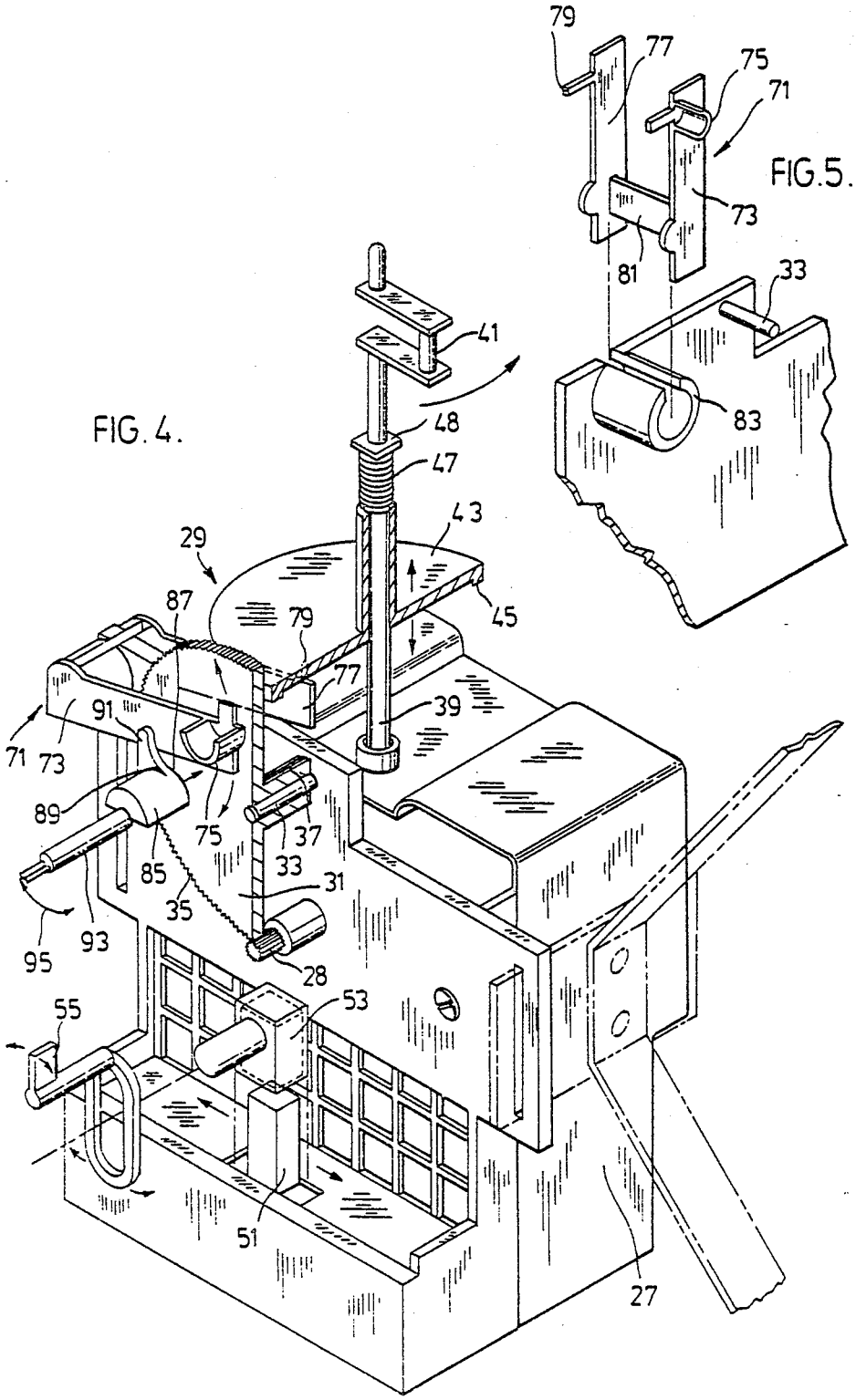
FIG. 4 is a perspective view showing in particular the drive system of the fan structure shown in FIG. 3.
FIG. 5 is an exploded perspective view of one of the components of the control mechanism of the fan structure shown in FIG. 3.

Drive system 29 is best shown in FIGS. 4 and 7. The drive system comprises drive shaft 39 mentioned above, drive wheel 21 rotationally mounted on spindle 33 and rotated by the output shaft 28 of motor 27 and drive pickup wheel 43.

Drive shaft 39 as shown in the drawings is longitudinally fixed between its upper and lower ends, and drive pickup member 43 is adapted to slide up and down along the drive shaft which is splined at its lower end to rotationally couple the drive pickup member to the drive shaft, i.e. the arrangement is such that rotation of the drive pickup member will produce rotation of the drive shaft. However the system could easily be set up such that the drive pickup wheel and the shaft are fixed to one another. With such a set up the drive shaft moves up and down with the pickup wheel and the rotation of the drive shaft being again effectively converted to reciprocation of the oscillating structure through the Scotch-yoke.

Furthermore the drive of the system through the rotating drive shaft enables the use of simple and efficient set-ups such as rotating cams and the like to oscillate the vanes.

Drive wheel 31 is provided with a drive portion 37 which is adapted to rotate the drive pickup member through its pickup portion 45, when the pickup wheel is moved downwardly into driving contact with drive portion 37. This drive contact position is shown in solid lines in FIG. 7. When the pickup wheel is in this position with the fan motor in operation, drive shaft 39 is caused to rotate through the drive pickup member resulting in oscillation of vanes or louvres 57.

However as clearly shown in FIG. 4 and as shown in dotted lines in FIG. 7, drive pickup member 43 can be slid upwardly away from the drive pickup position to discontinue further rotation of drive shaft 39, whereby the oscillation of the vanes is shut down with the fan motor continuing to operate.

The control mechanism for determining the up/down position of drive pickup wheel 43 is again best shown in FIG. 4. The mechanism comprises a spring 47 mounted on drive shaft 39 between an upper stop 48 and drive pickup wheel 43. This spring applies a constant downward pressure on the drive pickup wheel to force it to the drive pickup position.

The control mechanism further includes a double arm bar assembly generally indicated at 71 for moving the drive pickup wheel upwardly away from the drive pickup position against the pressure of spring 47. This double arm assembly includes a forward arm 73 on the front side of drive pickup wheel 31 as well as a rearward arm 77 on the back side of the drive pickup wheel. Forward arm 73 and rearward arm 77 are secured to one another by a bar 81 which fits into a grooved collar 83 as best shown in FIG. 5. The bar and groove arrangement allows the double arm assembly to be pivoted relative to the drive pickup wheel. It should be noted that arms 73 and 77 are of a length that permits them to clear output shaft 28 and drive portion 37 respectively during the pivoting of the double arm assembly.

The upward pivoting of the double arm assembly is controlled through a control member 85 which cooperates with semicircular extension 75 of the forward arm 73 on the double arm assembly. Control member 85 includes a cam portion 87, a central cradle-like seat 89 and a rear blocking member 91. Extending outwardly from control member 85 is an elongated shaft 93 which fits directly through the housing to rotationally position the control member relative to the double arm assembly. Provided at the extreme outer end of the shaft 93 is a switch 95 located to the exterior of the fan as shown in FIG. 1.

FIG. 4 shows the control mechanism holding the drive pickup wheel 43 in its upward position away from the drive wheel. In order to assume this position, the control member is rotated clockwise and cam portion 87 of control member 85 applies upward pressure on the base of semicircular extension 75 of arm 73 to move the double arm assembly upwardly. The semicircular extension then locks in rounded seat 89 of the control member against blocking arm 91 which prevents further clockwise rotation of the control member beyond the FIG. 4 position. As the double arm assembly is pivoted upwardly, the small upwardly extending lug 79 provided on rearward arm 77 drives into the bottom of drive pickup wheel 43, forcing the drive pickup wheel upwardly against the pressure of spring 47 to move the drive pickup wheel away from the drive pickup position. The drive pickup wheel is effectively held in this position through the control mechanism in which spring 47 applies a downward pressure on the drive pickup wheel to push downwardly on the double arm assembly and effectively lock the semicircular extension of the forward arm into seat 89 of control member 85.

In order to return the drive pickup wheel back to the drive pickup position, switch 95 is simply rotated anticlockwise such that the curved extension on the arm cams out of the cradle seat and drops down onto the front of the cam, which is shaped to allow the arm assembly to drop away from the drive pickup wheel, while spring 47 pushes the drive pickup wheel to the drive pickup position.

As can be seen in FIG. 4, electric motor 27 is provided with an internal switch 51 which through connector 53 is connected to the external switch 55 found at the front of the fan. This switch for the motor, which has both a high and a low speed, is totally separate from switch 95 for operating the control mechanism to the drive system of the fan. Therefore, the on/off switching of the fan motor is totally separate from the on/off vane oscillation control.

As will be appreciated from the description above, drive wheel 31 is at all times positively driven by the output shaft of the electric motor and a number of different setups may be used to provide the rotation of the drive wheel as well as the drive to the pickup wheel. A number of preferred setups are shown in FIGS. 4 and 7 through 10.

According to the setup shown in FIGS. 4 and 7, output shaft 28 and the outer periphery 35 of drive wheel 31 are geared to one another. The same setup is used between drive portion 37 and the pickup portion 45 of wheel 43 which are again geared to one another when in the pickup position.

In FIG. 8, the same gearing system is used between the drive wheel and the output shaft of the electric motor. However, a somewhat different arrangement is used in which drive portion 37*a* is encased with a relatively soft rubber material, such as neoprene, adapted to rotationally engage the knurled pickup region 45*a* of wheel 43*a*. The coefficient of friction between the drive member 37*a* and pickup portion 45*a* of wheel 43*a* is more than adequate to produce driving contact through the drive system.

Figure 10:
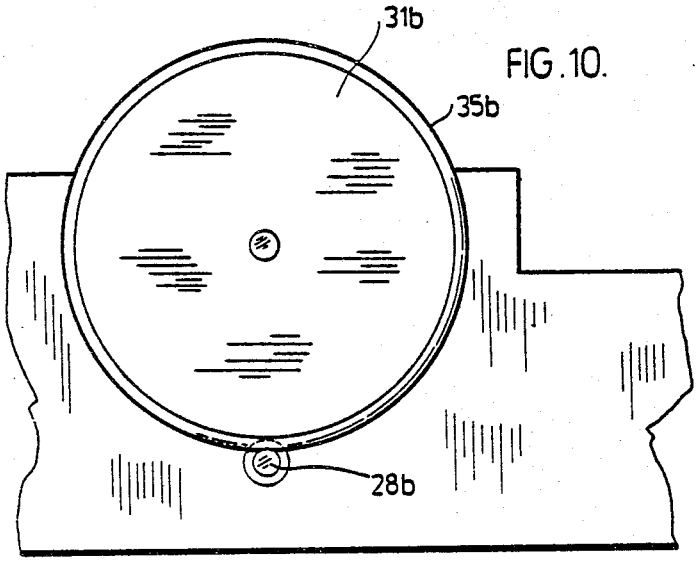

FIG. 10 shows an arrangement where the output shaft 28 is adapted to frictionally engage the rubber rim 35*b* of drive wheel 31*b*. Again this frictional contact between the motor output shaft and the drive wheel provides positive rotation of the drive wheel. With this set-up the drive wheel may e mounted on an idler arm allowing upward and downward movement of the drive wheel which normally assume a downward contacting position with the motor output shaft under its own weight and if necessary the added weight of the other drive components.

Figure 9:
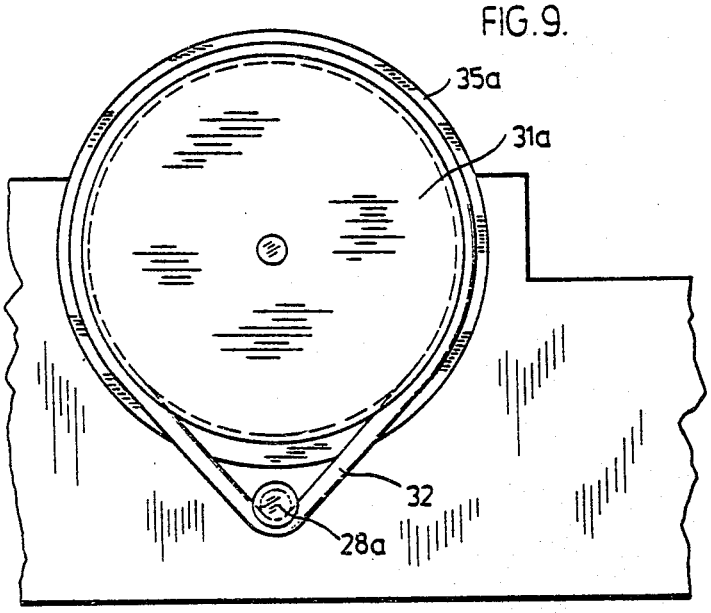
FIGS. 9 and 10 are front plan views showing the connection of the drive system to the motor shaft according to two different preferred embodiments of the present invention.

FIG. 9 shows still another arrangement used to positively drive wheel 31*a*. According to this arrangement, the periphery 35*a* of the wheel is stepped to receive a soft rubber, preferably neoprene, O-ring 31 wrapped around the drive wheel. Drive shaft 28*a* is also stepped or grooved to receive the O-ring so that it does not slip along the drive shaft. Frictional contact between the O-ring of the drive wheel and the output shaft of the electric motor provides rotation of drive wheel 31*a*.

As will be appreciated, the drive system is set up at all times, such that there is a speed reduction from the output shaft of the motor to the oscillator so that the vanes are oscillated at a controlled speed. Furthermore, it should be noted that the use of soft rubber material to provide drive to both the drive wheel and the pickup wheel, as described above, substantially eliminates noise from the oscillation of the fan.

A very appealing feature of the present invention lies in the fact that the components of the drive system, control mechanism, as well as the oscillating vanes are made from lightweight plastics material. As mentioned above, this takes substantial strains off the motor to drive the oscillating vanes allowing more power to the rotation of the fan blade. Furthermore, it enables the various setups for driving the drive wheel and the pickup wheel described above without slippage through the drive system when the vanes are free to oscillate. However as an added feature, the spring loading of the drive pickup wheel into pickup position with the drive wheel, as well as the very light weight of the drive pickup wheel, acts in effect as a clutch to allow gear slippage in the event that the oscillating vanes become jammed. This clutch effects occurs because the spring, although applying a constant pressure on wheel 43, is flexible and is not locked in position and, therefore, allows the light weight drive pickup wheel to move slightly upwardly and slip on the drive portion of the drive wheel if the vanes become jammed to prevent damage to the electric motor. Furthermore and again as a result of the light weight construction of the driving components, little if any damage is caused to either the drive wheel or the drive pickup wheel in the event of this desired slippage.

As has been described above, the fan structure, according to the present invention, is capable of directing the flow of air from the fan blade both upwardly and downwardly through the use of the supporting stand as well as from side to side by means of the oscillating vanes. The controls for the directional flow of air are simple while being extremely efficient in operation. The lightness of the weight of the components not only provides mechanical benefits within the drive assembly, but also substantially reduces the overall weight of the fan structure to enable different types of mountings including a wall and ceiling mounting of the fan. Furthermore although various preferred embodiments of the invention have been described herein in detail, it will be understood by those skilled in the art that variations may be made thereto without departing from the spirit of the invention or the scope of the appended claims.

The embodiments of the invention in which an exclusive property or privilege is claimed are defined as follows:

1. A fan structure having a housing, a fan blade rotatable within said housing, a plurality of vanes adapted to oscillate relative to said housing, oscillation means for oscillating said vanes, a drive system for driving said oscillation means, a motor for operating said drive system and said fan blade, a motor control switch and a control mechanism independent of said motor control switch for connecting and disconnecting said oscillation means with said motor through said drive system to turn on and to turn off oscillation of said vanes, said drive system comprising a rotating drive wheel, a longitudinally fixed drive shaft adapted to reciprocate said oscillation means, and a pickup wheel rotationally coupled to said drive shaft and moveable therealong to and away from a drive pickup position with respect to said drive wheel, said control mechanism comprising spring means for sliding said pickup wheel along said drive shaft to the drive pickup position to rotate said drive shaft and to connect said oscillation means with said motor for turning on the oscillation of said vanes, an adjustable control member for sliding said pickup wheel along said drive shaft away from said drive pickup position to discontinue further rotation of said drive shaft and disconnect said oscillation means from said motor for turning off the oscillation of said vanes, and a lock position for releasably locking said pickup wheel away from said drive pickup position.

2. A fan structure as claimed in claim 1 wherein said spring means comprises a helical spring fitted over said drive shaft to apply pressure on said drive pickup wheel.

3. A fan structure as claimed in claim 2, wherein said motor is provided with a driving output shaft rotating about a first generally horizontal axis, said rotating drive wheel being positively driven by said output shaft and presenting a drive portion rotating about a second generally horizontal axis, said drive shaft extending along a generally vertical axis and said pickup wheel being adapted to be rotated by said drive portion of said rotating drive wheel about said vertical axis.

4. A fan structure as claimed in claim 3, wherein said drive pickup wheel is positioned above said drive portion of said rotating drive wheel and is biased downwardly into contact therewith by said spring means, and said adjustable control member includes a manually controlled cam adapted to cam a pusher member upwardly to said drive pickup wheel for sliding the drive pickup wheel upwardly along said drive shaft away from said drive portion of said rotating drive wheel, said control member being further provided with means for holding said pickup wheel upwardly away from said drive pickup position.

5. A fan structure as claimed in claim 4, wherein said pusher member comprises a bifurcated arm assembly including a first arm to one side of said drive wheel and a second arm to the other side of said drive wheel, said first arm being provided with a curved extension adapted to ride over said cam as said arm assembly is pushed upwardly by said control member, said second arm being provided with an upward extension adapted to push upwardly on the bottom of said drive pickup wheel.

6. A fan structure as claimed in claim 5, wherein said control member includes a cradle seat for seating said curved extension when said drive pickup wheel is away from the drive pickup position, said spring means being adapted to apply a downward pressure on said drive pickup wheel to positively locate said curved extension in said cradle seat.

7. A fan structure as claimed in claim 6, wherein said control member is adjusted by rotation and includes a blocking member adapted to abut said curved extension of said arm assembly to prevent over-rotation of said control member.

8. A fan structure as claimed in claim 1, including a Scotch-yoke mechanism for oscillating said vanes from the rotation of said drive shaft.

9. A fan structure as claimed in claim 4, wherein said drive pickup wheel is made from light plastic material and said spring means is adapted to provide a clutch effect between said drive pickup wheel and said drive portion of said drive wheel in the event of jamming at said vanes during the oscillation thereof.

10. A fan structure as claimed in claim 1, wherein said drive wheel is provided with a geared drive portion and said pickup wheel has a geared skirt portion adapted to gearingly engage said geared drive portion.

11. A fan structure as claimed in claim 12, wherein said motor is provided with a geared output shaft which said drive wheel gearingly engages.

12. A fan structure as claimed in claim 1, wherein said motor is provided with an output shaft and said drive member is driven from said output shaft by means of a rubber ring wrapping around and frictionally engaging both said drive member and said output shaft.

13. A fan structure as claimed in claim 1, wherein said motor is provided with an output shaft and said drive member is frictionally driven by said output shaft.

14. A fan structure as claimed in claim 13, wherein said drive member is provided with a rubber wrapping therearound to frictionally engage said output shaft.

15. A fan structure as claimed in claim 3, wherein said drive portion of said rotating drive wheel is provided with a rubber wrapping and wherein said pickup wheel includes a fluted portion adapted to frictionally engage said rubber wrapping on said drive portion of said rotating drive wheel.

16. An fan structure as claimed in claim 1 including a stand secured to said housing, said housing being adjustable relative to said stand, said fan structure further being provided with friction means for securing said housing at different positions relative to said stand.

17. A fan structure as claimed in claim 16, including a tinnerman nut to either side of said housing to prevent loosening of said housing at said friction means during adjustment of the housing relative to the stand.

18. A fan structure as claimed in claim 15, wherein said stand includes a base portion adapted for a plurality of different mountings including upright mounting, wall mounting and ceiling mounting.

* * * * *